US005506470A

United States Patent [19]

Inoue et al.

[11] Patent Number: 5,506,470

[45] Date of Patent: Apr. 9, 1996

[54] COLOR CATHODE RAY TUBE

[75] Inventors: Masatsugu Inoue, Fukaya; Tohru Takahashi, Kumagaya, both of Japan

[73] Assignee: Kabushiki Kaisha Toshiba, Kawasaki, Japan

[21] Appl. No.: 464,465

[22] Filed: Jun. 5, 1995

Related U.S. Application Data

[63] Continuation of Ser. No. 88,341, Jul. 9, 1993, abandoned.

[30] Foreign Application Priority Data

Jul. 9, 1992 [JP] Japan ..... 4-181398

[51] Int. Cl.[6] ..... H01J 31/00

[52] U.S. Cl. ..... 313/477 R

[58] Field of Search ..... 313/477 R

[56] References Cited

U.S. PATENT DOCUMENTS

| | | | |
|---|---|---|---|
| 4,535,907 | 8/1985 | Tokita et al. | 220/2.1 A |
| 4,631,441 | 12/1986 | Morrell et al. | 313/408 |
| 4,677,339 | 6/1987 | Inoue et al. | 313/402 |
| 4,697,119 | 9/1987 | Inoue et al. | 313/408 |
| 4,777,401 | 10/1988 | Hosokoshi et al. | 313/461 |
| 4,839,556 | 6/1989 | Ragland, Jr. | 313/408 |
| 4,881,004 | 11/1989 | Inoue et al. | 313/408 |
| 4,943,754 | 7/1990 | Hirai et al. | 313/477 R |
| 5,151,627 | 9/1992 | Van Nes et al. | 313/477 R |
| 5,155,410 | 10/1992 | Wakasono et al. | 313/402 |

OTHER PUBLICATIONS

Patent Abstracts of Japan, vol. 013, No. 416 (E-831) 14 Sep. 1989 & JP-A-01 154 443 (Toshiba) 16 Jun. 1989.

*Primary Examiner*—Donald J. Yusko
*Assistant Examiner*—Lawrence O. Richardson
*Attorney, Agent, or Firm*—Cushman, Darby & Cushman

[57] ABSTRACT

A color cathode ray tube includes a face plate having a curved inner surface and a substantially rectangular effective area. A phosphor screen is formed on the inner surface of the face plate, and a shadow mask is arranged to oppose the phosphor screen. The effective area is formed such that, in an area of the effective area which is away from the center of the effective area by ½ or more of a distance between the center of the effective area and an axial end portion of the effective area in the major axis, a difference between the thickness of the face plate at a point which is on the minor axis and located away from the center of the effective area by a predetermined distance and the thickness of the face plate at a point which is on the diagonal axis and located away from the center of the effective area by the predetermined distance is smaller than a difference between the thickness of the face plate at the point on the diagonal axis and the thickness of the face plate at a point which is on the major axis and located away from the center of the effective area by the predetermined distance.

3 Claims, 5 Drawing Sheets

COLOR CATHODE RAY TUBE

This is a continuation of application Ser. No. 08/088,341, filed on Jul. 9, 1993, which was abandoned.

BACKGROUND OF THE INVENTION

1. Field of the Invention

The present invention relates to a color cathode ray tube having a shadow mask and, particular to a color cathode ray tube having a face plate, which prevents deterioration of an image caused by thermal deformation of the shadow mask.

2. Description of the Related Art

In general, a color cathode ray tube having a shadow mask comprises an envelop having a face plate and a funnel jointed to the panel. The face plate has a substantially rectangular effective area, which is formed of a curved surface, and a skirt portion provided on an outer peripheral portion of the effective area, and the funnel is jointed to the skirt portion. Formed on the inner surface of the effective area of the panel is a phosphor screen which is formed of three-color phosphor layers for emitting three colors, i.e., blue, green, and red. In the envelope, a shadow mask is arranged to face the phosphor screen. The shadow mask has a mask body having a large number of electron beam apertures, and the mask body is formed in the shape of a curved surface.

In a neck portion of the funnel is arranged an electron gun for emitting three electron beams. Three electron beams emitted from the electron gun are deflected by the magnetic field generated by a deflection yoke, which is mounted on the outside of the funnel, and horizontally and vertically scan the phosphor screen through the shadow mask. Thereby, a color image is displayed on the screen.

According to the above-structured color cathode ray tube, in order to display a color image having good color purity on the phosphor screen, it is needed that the three-color phosphor layers and the shadow mask are correctly arranged to have the relationship of a predetermined matching such that the three-electron beams, which pass through each electron beam aperture of the shadow mask and enter the phosphor screen, land on the corresponding phosphor layers, respectively. For this purpose, it is important to set the distance (value q) between the inner surface of the panel and the shadow mask to a design value.

However, even if the three-color phosphor layers and the shadow mask are arranged to have the predetermined positional relationship, deterioration of color purity still occurs due to thermal deformation of the shadow mask in the color cathode ray tube. Specifically, the area in which the electron beam apertures are formed accounts for to ⅓ or less of the entire mask body, and the most part of the electron beams collides with the shadow mask, and thus, the shadow mask is heated. Generally, a mask body is formed of a low carbon steel plate having iron as a main ingredient and thermally expands by the above-mentioned heating toward the phosphor screen. This expansion of the shadow mask is so called as doming. As a result, the value q varies, and the landing position of the electron beams onto the three-color phosphor layers shifts from a desired position, thereby deteriorating color purity.

The shift of the landing position (mislanding) of the electron beams onto the three-color phosphor layers due to the thermal expansion of the shadow mask differs depending on an image pattern, which is radiated on the phosphor screen, and radiating time of the image pattern.

More specifically, if an image is radiated on the phosphor screen for a long time, not only the mask body having a large number of electron beam apertures but also a mask frame, which is attached to the peripheral portion of the mask body and has a large thermal capacity, are heated. However, as disclosed in Published Examined Japanese Patent Application No. 44-3547, such a mislanding due to the heating can be effectively compensated by attaching an elastic support member supporting the shadow mask to the mask frame through bimetal. On the other hand, as mislanding, which occurs for a short period of time, there is a local mislanding which is generated when an image having high luminance is locally radiated on the screen. Such a mislanding cannot be compensated by the compensating means, i.e., bimetal.

In other words, if an image having high luminance is locally radiated on the phosphor screen by a high-current beam, local doming is generated in the mask body by collision of the high-current beam. In the doming part of the mask body, the electron beam apertures shift from the normal positions to the other positions. Due to this, the electron beams, which pass through the electron beam apertures formed at the normal positions and correctly land on the three-color phosphor layers, cannot land on the normal positions of the three-color phosphor layers since the electron beams pass through the electron beam apertures displaced at the other positions. Such a local mislanding cannot be compensated by compensating, i.e., bimetal.

In order to examine the relationship between the high-current beam pattern and the mislanding which occurs for a short period of time, electron beams having a rectangular pattern were radiated on a phosphor screen through a shadow mask by means of a signal generator, and the shape, the size, and the landing position of the rectangular pattern onto the shadow mask were variously changed. As a result, it was ascertained that the amount of the mislanding, i.e., the distance between the actual landing position of the beam and the correct landing position thereof, was relatively small when the high-current beam pattern was radiated over substantially the entire surface of the phosphor screen. However, when the high-current beam pattern, which is elongated in a vertical direction, was radiated on that portion of the screen which is slightly apart from the peripheral portion of the screen toward the center thereof in the horizontal direction (X axis direction), the amount of the mislanding becomes the largest.

The relationship between the two types of high-current beam patterns and the mislanding can be explained as follows:

Generally, a television cathode ray tube is designed such that current to be supplied does not exceed a constant value which corresponds to an average cathode current of the cathode ray tube. In a case that the high-current beam pattern is radiated over substantially the entire surface of the phosphor screen, therefore, a current, which flows into the shadow mask per unit area, is smaller than the case that a high-current beam pattern with a small size is radiated. Thus, the rise in temperature of the shadow mask is small. Moreover, in the case that the high-current pattern with a small size is radiated on the central portion of the phosphor screen, mislanding hardly occurs even if the shadow mask is thermally deformed. However, as the beam pattern is moved from the central portion of the phosphor screen to the horizontal peripheral portion thereof, the frequency of the thermal deformation of the shadow mask, which appears on the screen as a mislanding, becomes high. However, in the vicinity of the horizontal peripheral portion of the phosphor screen, since the peripheral portion of the mask body is attached to the mask frame, the amount of the deformation of the mask body is small. Consequently, at that portion of the mask body which is slightly apart from the horizontal peripheral portion of the mask to the central portion thereof, the amount of the thermal deformation of the shadow mask is large and the amount of the mislanding becomes the largest.

Particularly, in a recent color cathode ray tube, an FS (Flat Square) tube in which an effective area of the face plate is flattened is mainly used. In this type of the color cathode ray tube, the mask body is flattened to correspond to the effective area of the panel. Therefore, in such a color cathode ray tube, mislanding of electron beams due to thermal deformation of the shadow mask increases.

Published Unexamined Japanese Patent Applications No. 61-163539 and No. 61-88427 disclose structures for compensating the mislanding of electron beams, in a color cathode ray tube whose effective area of the face plate is flattened, by improving the shape of the shadow mask. However, in a cathode ray tube having a flattened effective area, it is impossible to sufficiently compensate the mislanding of the electron beams only by changing the shape of the shadow mask.

Published Unexamined Japanese Patent Applications No. 64-17360 and No. 1-154443 disclose a structure wherein the mislanding is compensated by changing the shape of the effective area of the face plate together with the shadow mask. However, even if such a compensation is made, sufficient correction cannot be obtained in color cathode ray tubes, which have been recently developed, having a face plate which includes a substantially spherical effective surface such that an external image reflecting on the outer surface of the face plate is natural without making a user feel visually uncomfortable.

SUMMARY OF THE INVENTION

The present invention has been made in consideration of the above-mentioned problems, and its object is to provide a color cathode ray tube which can effectively correct deterioration in color purity, which is caused by local thermal deformation of a shadow mask without largely changing the structure of a shadow mask and a face plate even in a color cathode ray tube having the face plate which has substantially spherical surfaces such that an external image reflecting on the outer surface of the face plate can be seen natural without making a user feel visually uncomfortable.

In order to achieve the above object, according to the present invention, there is provided a color cathode ray tube comprising a face plate having a curved inner surface and a substantially rectangular effective area; a phosphor screen formed on the inner surface of the face plate; and a shadow mask arranged in opposite to the phosphor screen. The effective area is formed such that, in an area of the face plate which is away from the center of the effective area by ½ or more of a distance between the center of the effective area and an axial end portion of the effective area in the major axis, a difference between the thickness of the face plate at a point which is on the minor axis and located away form the center of the effective area by a predetermined distance and the thickness of the face plate at a point which is on the diagonal axis and located away from the center of the effective area by the predetermined distance is smaller than a difference between the thickness of the face plate at the point on the diagonal axis and the thickness of the face plate at a point which is on the major axis and located away from the center of the effective area by the predetermined distance.

According to the above-mentioned structure, if the shadow mask is formed to have substantially the same shape as the inner surface of the face plate, making it possible to reduce a radius of curvature of a cross section parallel to the minor axis of the inner surface of the face plate at an intermediate portion on the major axis where local thermal deformation of the shadow mask is large. Therefore, a distance between the inner surface of the face plate and the shadow mask can be made substantially constant over the entire effective area of the face plate. As a result, it is possible to effectively compensate deterioration in color purity, which is caused by the local thermal deformation of the shadow mask, even if the outer surface of the face plate is formed in a flat shape, which is formed of substantially spherical surfaces such that an external image reflecting on the outer surface of the face plate can be seen natural without making a user feel visually uncomfortable.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 9 show a color cathode ray tube according to an embodiment of the present invention, in which:

FIG. 1 is a longitudinal sectional view of the color cathode ray tube;

FIG. 2 is a plane view of the color cathode ray tube;

FIG. 3 is a perspective view schematically showing a face plate;

FIG. 4 is a graph showing outer and inner shapes of the face plate along a major axis of the face plate;

FIG. 5 is a graph showing the outer and inner shapes of the face plate along a minor axis of the face plate;

FIG. 6 is a graph showing the outer and inner shapes of the face plate along a diagonal axis of the face plate;

FIG. 7 is a graph showing thickness distribution of the face plate along the major axis, diagonal axis, and minor axis, respectively;

FIG. 8 is a graph showing a difference between the thickness of the face plate on the major axis and that on the diagonal axis; and a difference between the thickness of the face plate on the diagonal axis and that on the minor axis; and FIG. 9 is a graph showing thickness distribution of a face plate along the major axis, diagonal axis and minor axis of the face plate of the conventional color cathode ray tube.

DETAILED DESCRIPTION OF THE PREFERRED EMBODIMENT

A color cathode ray tube according to an embodiment of the present invention will be explained in detail with reference to the accompanying drawings.

Figure 1:
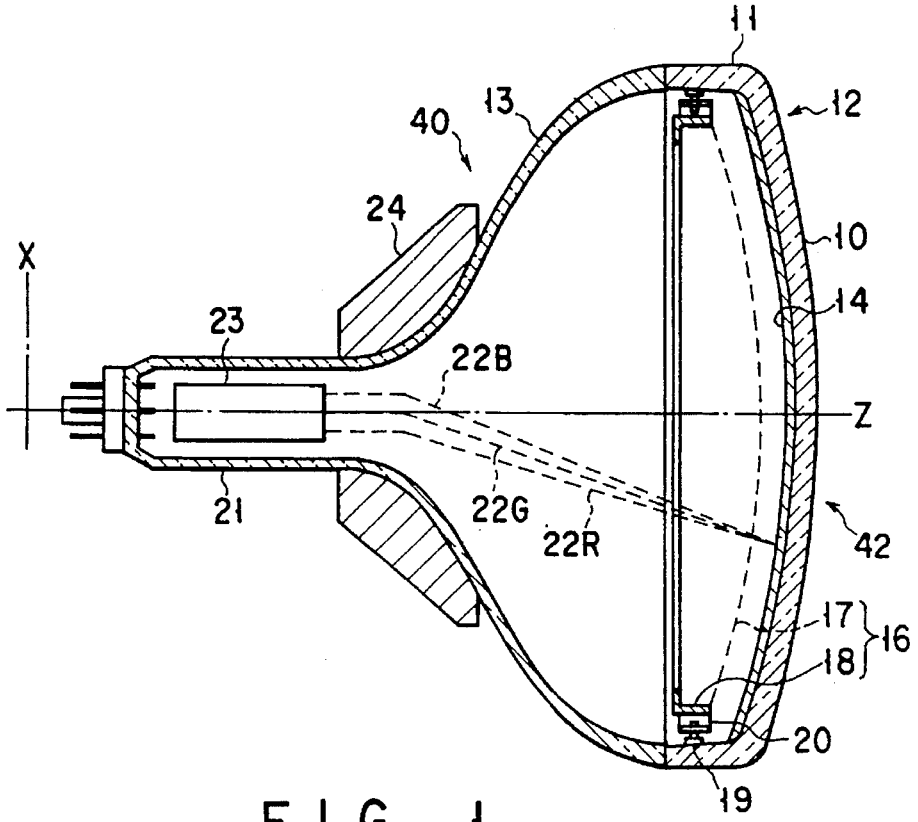
Figure 2:
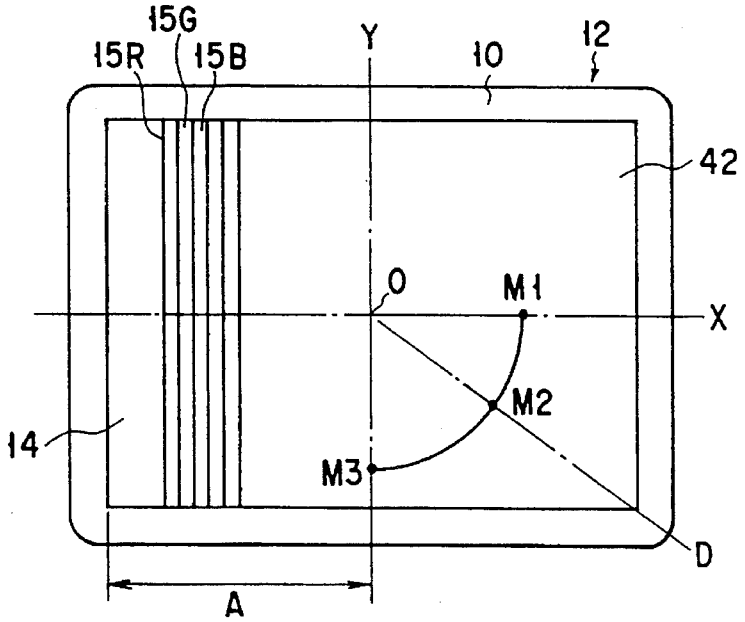

As shown in FIGS. 1 and 2, a color cathode ray tube comprises a vacuum envelope 40 which has a panel 12 and a funnel 13 jointed to the panel. The panel 12 has a substantially rectangular face plate 10 and a skirt portion 11 provided on a peripheral portion of the face plate, and is integrally formed of glass. The funnel 13 is integrally jointed to the skirt portion 11.

A phosphor screen 14, which is made of three-color phosphor layers for emitting three colors, i.e., blue, green, and red, is formed over substantially the entire inner surface of the face plate 10. In the face plate 10, an area having the phosphor screen 14 forms an effective area 42. The outer surface of the effective area 42 of the face plate 10 is formed in a spherical shape having a predetermined curvature to be explained later such that an external image reflecting on the outer surface of the face plate can be seen natural without making a user feel visually uncomfortable. Also, the inner surface of the effective area 42 is formed to have a concave surface of aspherical shape having a predetermined curvature to be explained later. Three-color phosphor layers 15B, 15G, and 15R are formed in a stripe manner extending in parallel to a minor axis (Y axis) of the face plate, which passes through the center of the effective area 42 of the face plate 10, and are arranged in a major axis (X axis) direction of the face plate.

In the envelope 40 is arranged a substantially rectangular shadow mask 16 to oppose the phosphor screen 14. The shadow mask 16 comprises a mask body 17 having a large number of electron beam apertures and a predetermined curvature, and a mask frame 18 attached to a peripheral portion of the mask body 17. The shadow mask 16 is supported in the inside of the panel 12 by stud pins 19, which are attached to the inner surface of the skirt portion 11 of the panel 12, and an elastic support members 20, which are attached to the mask frame 18 and engaged with the stud pins 19.

In a neck portion 21 of the funnel 13 is arranged an electron gun 23 for emitting three electron beams 22B, 22G and 22R, which are provided on one line passing on a common horizontal plane. The three electron beams 22B, 22G and 22R emitted from the electron gun 23 are deflected by the magnetic field generated by a deflection yoke 24 which is mounted on the outer surface of the funnel 13. Thus, the three electron beams 22B, 22G and 22R horizontally and vertically scan the phosphor screen 14 through the shadow mask 16, so that a color image is displayed on the effective area 42 of the face plate 10.

Figure 3:
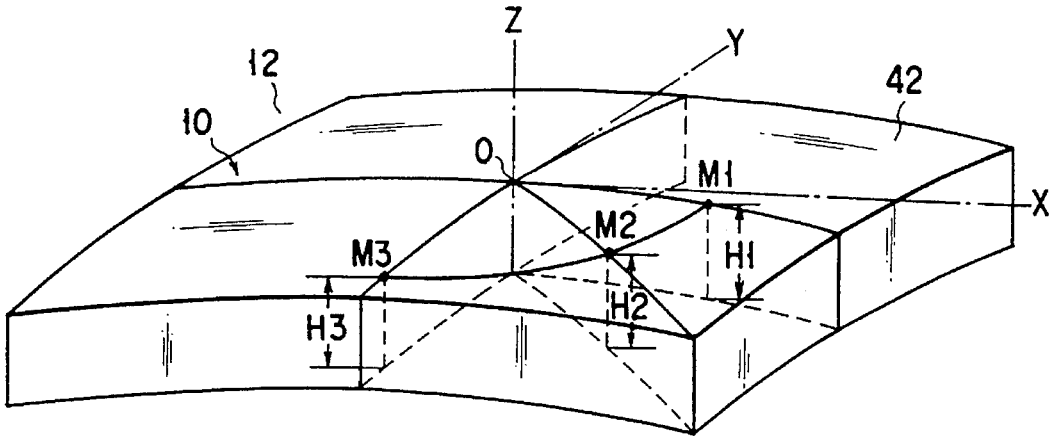

The outer surface of the effective area 42 of the face panel 10 is formed of a combination of two spherical surfaces having different radius of curvature, as one example. More specifically, as shown in FIG. 3, it is assumed that the central axis of the face plate 10, that is, the central axis of the effective area 42 (coaxial with a tube axis) is Z, a radius of curvature close to the center of the effective area is R1, a radius of curvature of the peripheral portion of the effective area is R2, and a distance between the center of the effective area and the spherical surface at the peripheral portion is S. In that area near the center of the effective area which satisfies a relationship shown by the following equations (1) and (2), the outer surface of the effective area 42 is formed to have a shape shown by the following equation (4). In that area near the peripheral portion of the effective area which satisfies a relationship shown by the following equations (2) and (3), the outer surface of the effective area 42 is formed to have a shape shown by the following equation (5 ).

$$rf < \{R1/(R1 - R2)\}S \tag{1}$$

$$rf = \sqrt{X^2 + Y^2} \tag{2}$$

$$rf > \{R1/(R1 - R2\}S \tag{3}$$

$$Z = -\{R1 - \sqrt{R1^2 - rf^2}\} \tag{4}$$

The respective values in these equations, as one example, will be shown as follows:

R1=1607 mm

R2=1417 mm

S=17.9 mm

On the other hand, the inner surface of the effective area 42 of the face plate 10 is formed to have a shape shown by the following equation (6).

$$Z = -\sum_{i=0}^{3}\sum_{j=0}^{3} A_{4i+j}X^{2j}Y^{2j} \tag{6}$$

wherein $A_{4i+j}$ is a coefficient, and A0=0, since Z=0 at the center of the effective area 42, which is the center (X=0, Y=0) of the coordinates. Coefficients A1 to A15 will have the values shown in the following Table:

| | | | |
|---|---|---|---|
| A1 | $0.3197529 \times 10^{-3}$ | A9 | $-.9433436 \times 10^{-12}$ |
| A2 | $0.4418681 \times 10^{-9}$ | A10 | $0.2726098 \times 10^{-16}$ |
| A3 | $0.4030513 \times 10^{-14}$ | A11 | $-.2003733 \times 10^{-21}$ |
| A4 | $0.3679484 \times 10^{-3}$ | A12 | $-.2472166 \times 10^{-13}$ |
| A5 | $0.1775299 \times 10^{-7}$ | A13 | $0.1290694 \times 10^{-16}$ |
| A6 | $-.5105528 \times 10^{-12}$ | A14 | $-.3779825 \times 10^{-21}$ |
| A7 | $0.3550864 \times 10^{-17}$ | A15 | $0.2781490 \times 10^{-26}$ |
| A8 | $0.2533988 \times 10^{-8}$ | | |

Figure 4:
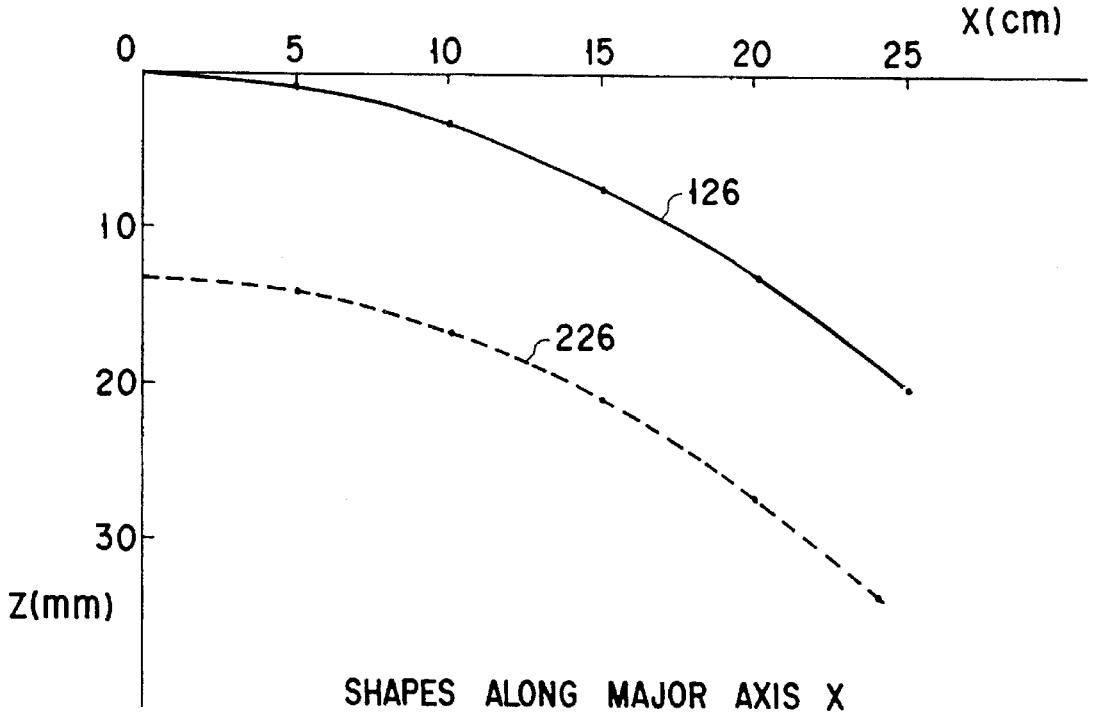
Figure 5:
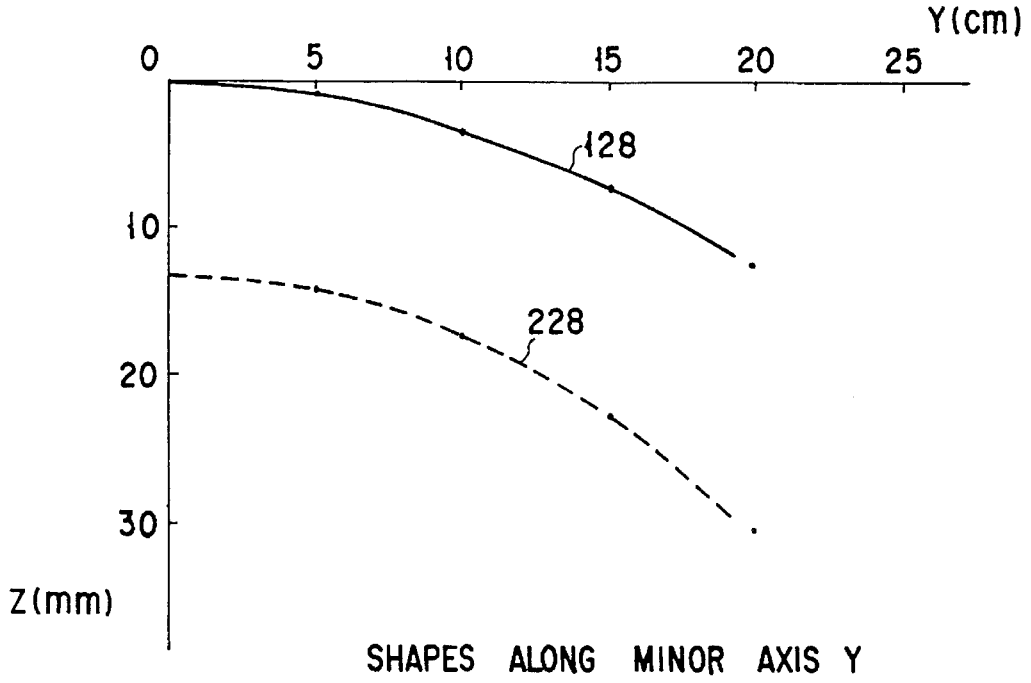
Figure 6:
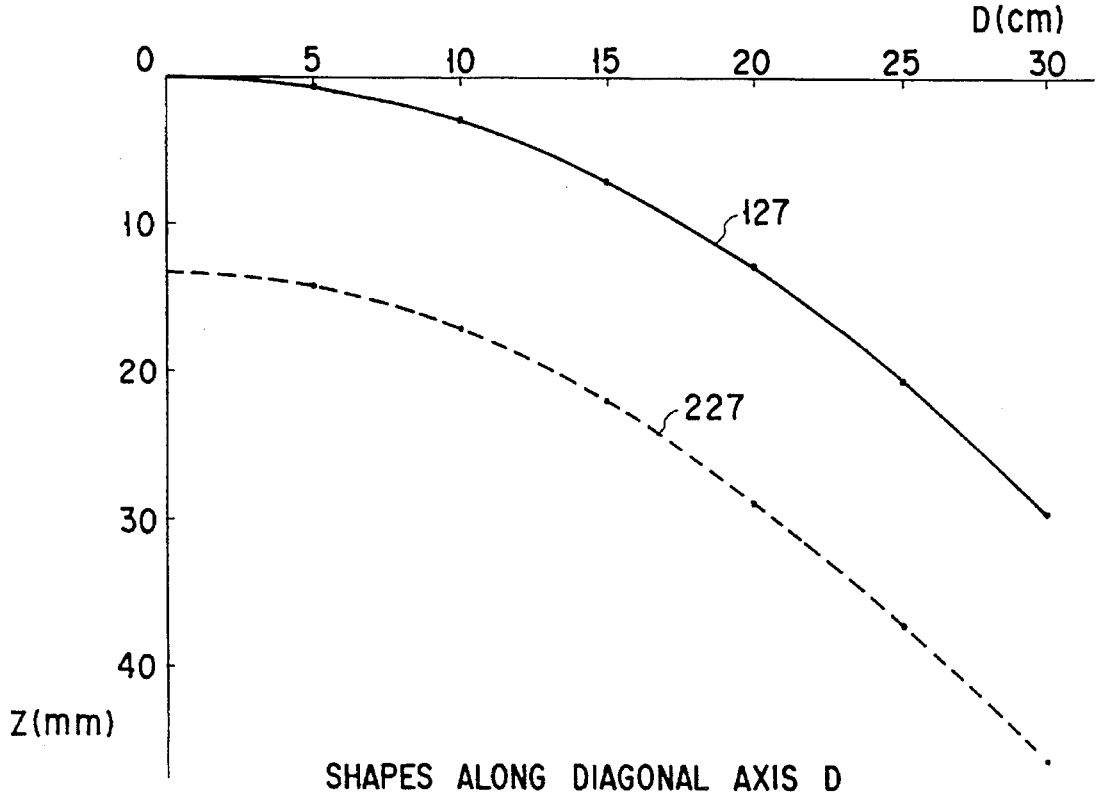

FIG. 4 shows the shapes of the outer and inner surfaces of the face plate 10 along the major axis X of the face plate, FIG. 5 shows the shapes of the outer and inner surfaces of the face plate along the minor axis Y, and FIG. 6 shows the shapes of the outer and inner surfaces of the face plate along the diagonal axis D of the face plate. In these figures, solid lines 126, 127, and 128 show the shape of the outer surface, respectively, and chained lines 226, 227 and 228 show the shape of the inner surface, respectively.

Figure 7:
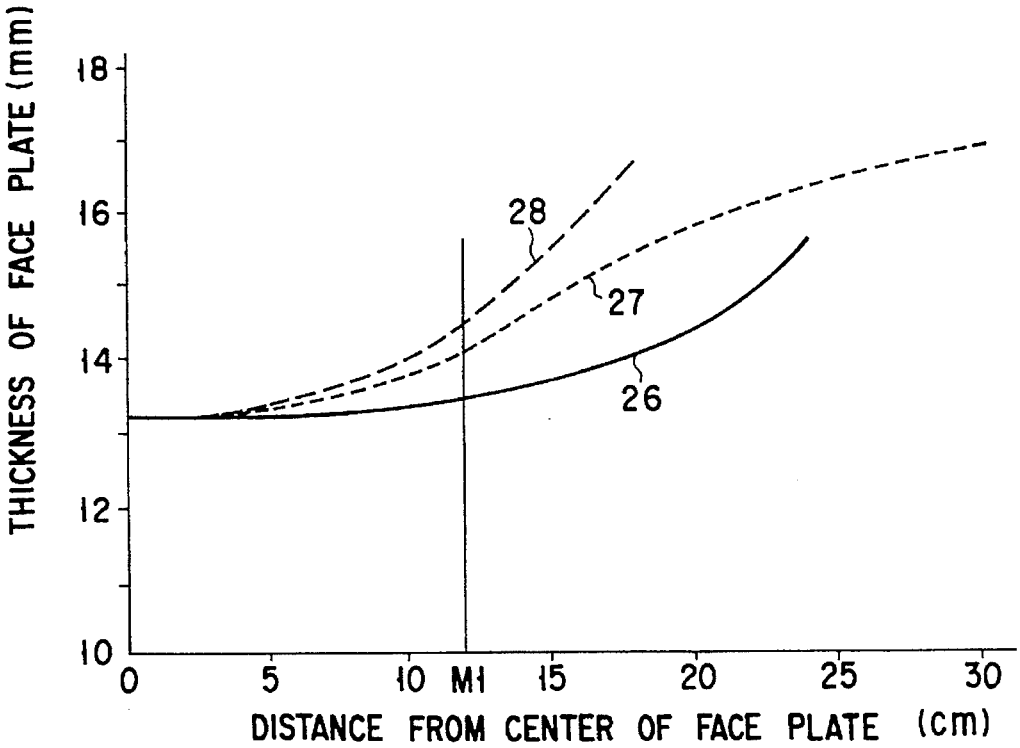

If the effective area 42 of the face plate 10 is formed as mentioned above, the effective area has thickness distribution as shown in FIG. 7. Specifically, the respective thickness distribution of the face plate 10 along the major axis (X axis), the diagonal axis (D axis), and the minor axis (Y axis) are shown by curves 26, 27, and 28, respectively.

Figure 8:
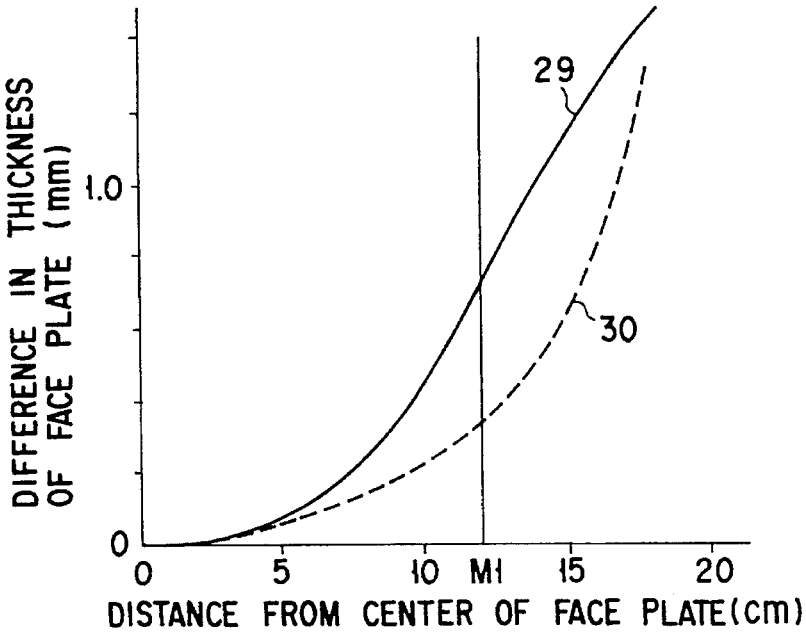

As a result, as shown in FIGS. 2 and 3, the difference between the thickness H1 of the face plate at a point M1 on the major axis X away from the center 0 of the effective area 42 a predetermined distance and the thickness H2 the face plate at a point M2 on the diagonal axis D away from the center 0 by the same distance varies as shown by the curve 29 in FIG. 8 in accordance with a distance from the center 0. The difference between the thickness H3 of the face plate at a point M3 on the minor axis Y away from the center 0 by the predetermined distance and the thickness H2 at the point M2 on the diagonal axis D varies as shown by the curve 30 in accordance with a distance from the center 0. Specifically, the difference (H3–H2) between the thickness H3 at the point M3 on the minor axis Y, at the same distance as the point M1 on the major axis X, and the thickness H2 at the point M2 on the diagonal axis D is smaller than the difference (H2–H1) between the thickness H2 and the thickness H1. The effective area 42 is formed so as to satisfy the above relationship (H3 –H2<H2–H1) even in the area in which the distance from the center 0 is large. If it is assumed that a distance between the center 0 and an end edge of the effective area 42 in the major axis X is A, the face plate 10 is formed so as to satisfy the relationship (H3 –H2<H2–H1) in the area away from the center 0 by A/2 or more. The relationship between the thickness of the respective points is H3>H2>H1.

Figure 9:
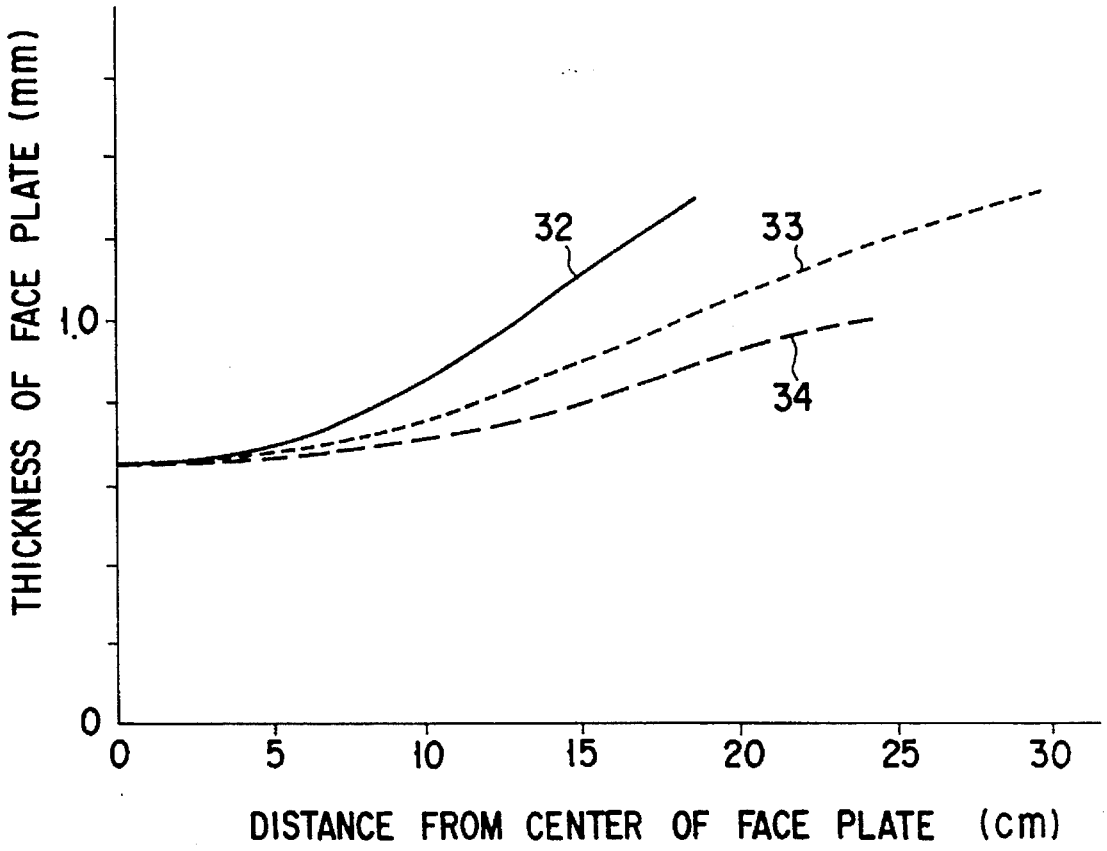
(PRIOR ART) FIG. 9

In a conventional face plate, the effective area is formed to have thickness distribution shown in FIG. 9. In FIG. 9, a thickness distribution along the major axis is shown by a curve 32, a thickness distribution along the diagonal axis is shown by a curve 33, and a thickness distribution along the minor axis is shown by a curve 34. The difference between the thickness of the face plate at a point on the major axis away from the center of the effective area by a predetermined distance and the thickness at a point on the diagonal away from the center by the same distance is smaller than the difference between the thickness at the point on the diagonal axis and the thickness at a point on the minor axis away from the center by the predetermined distance. This is because the diagonal axis of the face plate is closer to the major axis than the minor axis. In contrast to this, the thickness of the effective area 42 of the face plate 10 of the present embodiment has a relation, which is opposite to the thickness distribution of the effective area of the conventional face plate, even though the diagonal axis is closer to the major axis than the minor axis.

In a case that the effective area 42 of the face plate 10 is structured to have the above-mentioned thickness distribution, the radius of curvature of the cross section (Y - Z parallel cross section) at the intermediate portion in the direction of the major axis of the face plate 10, which extends in the direction parallel to the minor axis of the face plate 10, can be smaller than that of the conventional face plate, even if the outer surface of the effective area 42 is shaped to be substantially flat by combining one or two spherical surfaces such that an external image reflecting on the outer surface of the effective area becomes a natural image without making a user feel visually uncomfortable. Since the mask body 17 of the shadow mask 16 is formed to have substantially the same shape as the inner surface of the face plate 10, the radius of curvature of the Y - Z parallel cross section of the mask body can be made smaller. Therefore, even if the shadow mask 16 is thermally deformed locally, influence of the deformation on the landing of the electron beams can be reduced. Thus, it is possible to effectively compensate deterioration in color purity in the area of the face plate opposite to the intermediate portion of the shadow mask in the direction of the major axis, where local thermal deformation of the shadow mask 16 is most easily generated.

Regarding a 23-inch color cathode ray tube with a deflection angle of 110° as one example, the effective area of the face plate was formed with thickness distribution shown by curves 26, 27 and 28 in FIG. 7. As a result, mislanding of the electron beams, which is caused by thermal deformation of the shadow mask having a shape corresponding to the face plate, was reduced about 15%.

In addition, even if the effective area of the face plate is formed with the thickness distribution shown by curves 26, 27, and 28 in FIG. 7, the mechanical strength of the panel was substantially unchanged.

As described above in detail, according to the color cathode ray tube of the present invention, the substantially rectangular effective area of the face plate is formed such that, in an area of the effective area which is away from the center of the effective area by ½ or more of the distance between the center and the axial end portion in the major axis direction of the effective area, the difference between the thickness of the face plate at a point on the minor axis at a distance from the center of the effective area and the thickness of the face plate at a point on the diagonal axis at the same distance from the center is smaller than the difference between the thickness of the face plate at the point on the diagonal axis and the thickness of the face plate at a point on the major axis at the same distance from the center. Therefore, only by partially changing the shape of the curved surfaces of the face plate and shadow mask without largely changing the structure thereof, it is possible to effectively compensate deterioration in color purity, which is caused by local thermal deformation of the shadow mask, even in the flat panel having of substantially spherical surfaces such that an external image reflecting on the outer surface of the face plate can be seen natural without making a user feel visually uncomfortable.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A color cathode ray tube comprising:

a face plate of varying thickness having a curved inner surface and a substantially rectangular effective area, the effective area having a center, and major, minor and diagonal axes passing through the center, the minor axis having an endpoint delineating a first outer edge of the effective area, the major axis having an endpoint delineating a second outer edge of the effective area, the diagonal axis extending from the center to a point of intersection between the first outer edge and the second outer edge;

a phosphor screen formed on the inner surface of the face plate; and a shadow mask arranged to oppose the phosphor screen and having a shape substantially the same as the inner surface of the face plate;

the effective area being formed such that, at points equidistant from the center of the effective area and displaced from the center by at least one half a distance from the center to the end of the major axis, a difference between the face plate thickness at the minor axis and the face plate thickness at the diagonal axis is less than a difference between the face plate thickness at the diagonal axis and the face plate thickness at the major axis.

2. A color cathode ray tube according to claim 1, wherein said effective area has a relationship of H3>H2>H1, wherein H1, H2, and H3 are the thickness of the face plate at portions on the major, diagonal, and minor axes at the same distance from the center of the effective area.

3. A color cathode ray tube according to claim 1, wherein said effective area has a substantially spherical outer surface.

* * * * *